US012709971B2

(12) United States Patent
Soriano Rementeria et al.

(10) Patent No.: US 12,709,971 B2
(45) Date of Patent: Aug. 18, 2026

(54) DEVICES, SYSTEMS, AND METHODS FOR GENERATING DRILLING REPORTS

(71) Applicant: Schlumberger Technology Corporation, Sugar Land, TX (US)

(72) Inventors: Agustin Soriano Rementeria, Montpellier (FR); Myriam Amour, Montpellier (FR); Valerian Guillot, Montpellier (FR); Wissame Bennah, Montpellier (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 35 days.

(21) Appl. No.: 18/772,342

(22) Filed: Jul. 15, 2024

(65) Prior Publication Data

US 2026/0015931 A1 Jan. 15, 2026

(51) Int. Cl.
*G06Q 10/00* (2026.01)
*E21B 44/00* (2006.01)

(52) U.S. Cl.
CPC ..... *E21B 44/00* (2013.01)

(58) Field of Classification Search
None
See application file for complete search history.

(56) References Cited

U.S. PATENT DOCUMENTS 12,008,332 B1 6/2024 Gardner
2016/0275133 A1* 9/2016 Moore ..... E21B 47/00
2016/0291575 A1* 10/2016 Moore ..... E21B 49/08
2020/0174152 A1 6/2020 Kesserwan et al.
2020/0277848 A1* 9/2020 Johnston ..... E21B 44/00
2021/0165963 A1 6/2021 Mendes et al.
2022/0237550 A1* 7/2022 Jennings ..... G06Q 10/063
2023/0399935 A1* 12/2023 Guedes de Carvalho ..... E21B 44/00
2023/0409783 A1* 12/2023 Kulkarni ..... E21B 49/008
(Continued)

FOREIGN PATENT DOCUMENTS

AU 2008279816 A1 1/2009

OTHER PUBLICATIONS

Zhong, Ruizhi, Machinelearningfordrilling applications: A review, 2022, Science Direct—Journal of Gas Science and Engineering, https://www.sciencedirect.com/science/article/pii/S1875510022003936, p. 1-17. (Year: 2022).*
(Continued)

*Primary Examiner* — Joseph M Waesco
(74) *Attorney, Agent, or Firm* — Kyle R. Miiller

(57) ABSTRACT

A drilling report generation system may receive a query to generate the drilling report, the query including a time period and a persona, the persona including a frame of reference for the drilling report. A drilling report generation system may generate a prompt for a drilling report model, the prompt including the time period and the persona. A drilling report generation system may input the prompt to the drilling report model, the drilling report model generating the drilling report, wherein the drilling report model generates the drilling report based on a primary source and one or more secondary sources, the primary source and the one or more secondary sources including subject matter associated with the persona. A drilling report generation system may provide the drilling report to a user.

14 Claims, 8 Drawing Sheets

(56) References Cited

U.S. PATENT DOCUMENTS

| | | | | |
|---|---|---|---|---|
| 2024/0029176 | A1 | 1/2024 | Ivachev | |
| 2024/0095429 | A1* | 3/2024 | Hudson | G06Q 50/02 |
| 2024/0352839 | A1* | 10/2024 | Wheatley | G06Q 10/0631 |
| 2024/0368978 | A1* | 11/2024 | Johnson | E21B 44/00 |
| 2025/0111336 | A1* | 4/2025 | Michalopulos | E21B 44/00 |
| 2025/0198275 | A1* | 6/2025 | Antonio | E21B 44/00 |
| 2025/0342311 | A1* | 11/2025 | Fitzpatrick | G06F 9/451 |
| 2025/0356273 | A1* | 11/2025 | Menon | G06Q 10/063 |

OTHER PUBLICATIONS

Mullick, A. et al., "On The Persona-based Summarization of Domain-Specific Documents", arXiv:2406.03986v1, Jun. 6, 2024, 17 pages.
Walt Mayfield and Felipe Lopez, Customize large language models with oil and gas terminology using Amazon Bedrock, AWS, Feb. 13, 2024, 10 pages.

* cited by examiner

DEVICES, SYSTEMS, AND METHODS FOR GENERATING DRILLING REPORTS

BACKGROUND OF THE DISCLOSURE

Drilling is used to access subterranean formations for exploration, the extraction of natural resources (e.g., oil, natural gas, water), power generation, other uses, and combinations thereof. Drilling operations, including drilling, production, intervention, recovery, and closure operations, may include operations or activities occur to achieve a particular goal. During a particular drilling operation, multiple different parties may perform tasks at the job site. Each party may have a particular expertise or focus, which may be different from the other parties. Different parties may generate reports based on operations they performed.

SUMMARY

In some aspects, the techniques described herein relate to a method for generating a drilling report. A drilling report generation system receives a query to generate the drilling report. The query includes a time period and a persona. The persona includes a frame of reference for the drilling report. The drilling report generation system generates a prompt for a drilling report model. The prompt includes the time period and the persona. The drilling report generation system inputs the prompt to the drilling report model. The drilling report model generates the drilling report based on a primary source and one or more secondary sources. The primary source and the one or more secondary sources include subject matter associated with the persona. The drilling report generation system provides the drilling report to a user.

In some aspects, the techniques described herein relate to a method for training a drilling report model. A drilling report generation system inputs a primary source to the drilling report model. The primary source includes an operator report having at least one operating code and a description. The at least one operating code is associated with a pre-assigned activity. The description describes the pre-assigned activity. The drilling report generation system inputs a secondary source to the drilling report model. The drilling report generation system inputs, to the drilling report model, a drilling report associated with the primary source and the secondary source. The drilling report is annotated with one or more annotations based on the at least one operating code, the description, the primary source, the secondary source, and a persona associated with the at least one operating code. The drilling report generation system trains the drilling report model to generate a drilling report based on associations between the one or more annotations and the primary source and the secondary source.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Figure 1:
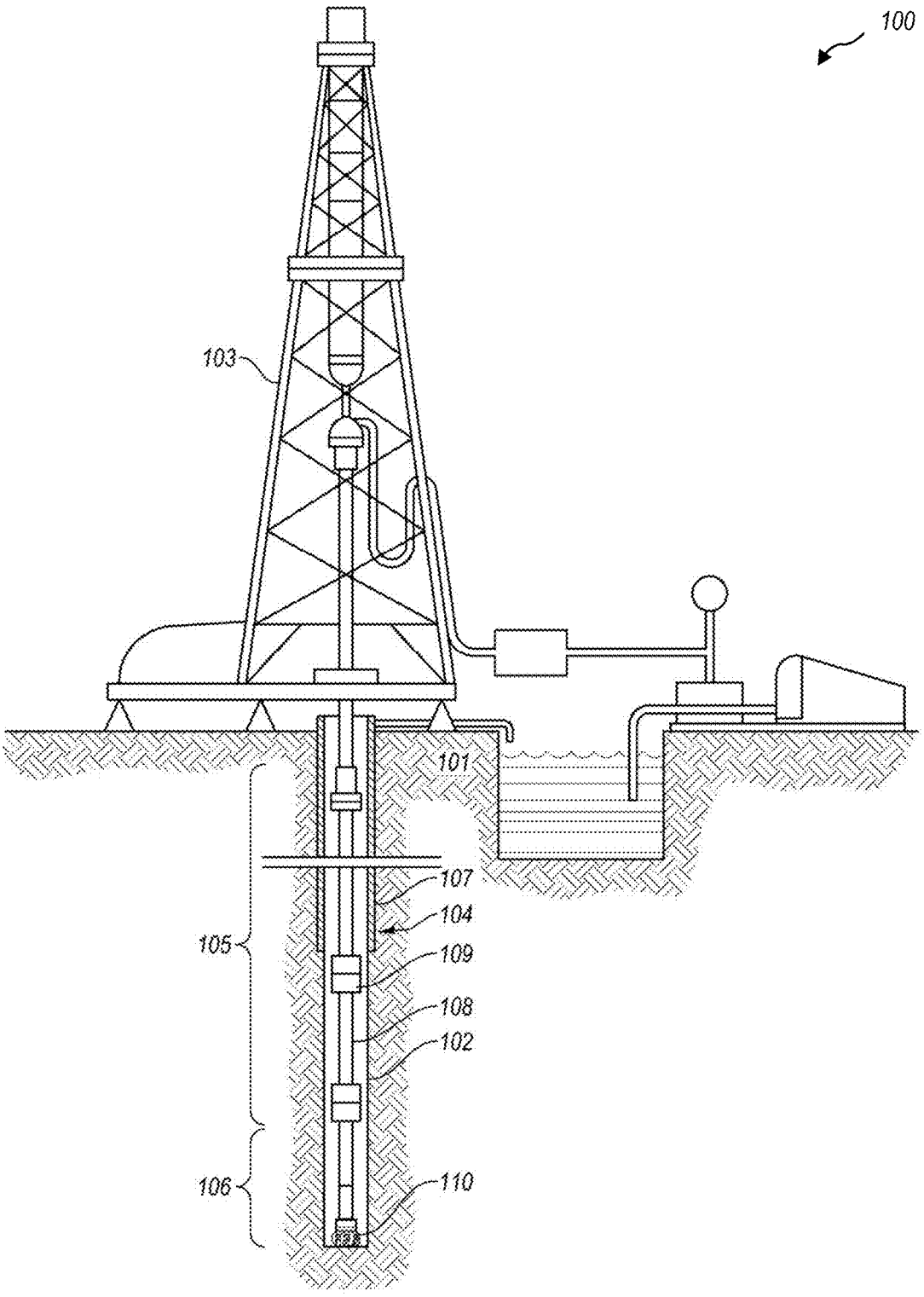
FIG. 1 is a representation of a drilling system, according to at least one embodiment of the present disclosure.

This disclosure generally relates to devices, systems, and methods for generating drilling reports from operator and service companies reports. Drilling operators may develop reports that include a record of drilling activities performed over a period of time. For example, a drilling operator may manually or automatically input into an operator report an operating code and a description of the activity performed associated with that operating code. The operating code may be a pre-designated code representative of a known activity or activity category. The operator may prepare additional description to provide specific details regarding the activity associated with the pre-designated operating code. But, while the operating code and the language or jargon associated with an operator's description may be well-known to operations personnel, other interested parties may not be as familiar with the operating codes and operator's language. Such interested parties may include managers, corporate executives, wellbore owner representatives (e.g., the client), public figures, any other interested party, and combinations thereof. Additionally, operational codes might not be extensive enough to describe the sets of the operation with enough granularity and the operator's description provides a more extensive understanding of the operation during the time when it was executed.

In some situations, an operator, engineer, or other person may develop a plain language drilling report. The plain language drilling report may summarize, consolidate, and/or convert one or more operator reports into a plain language drilling report that may be easily understood by an interested party. But developing such reports may be time-consuming and costly. Further, such reports may contain errors, may not include some relevant information, or may include undesired formatting or subject-matter.

Conventional techniques to automate plain-language drilling report generation may analyze the operating code and the description, and convert the operating code and description to plain language. But such techniques may simply regurgitate all the information from the operator report, potentially resulting in a longer report. Further, such techniques are limited to the information contained in the operator report. This may limit the applicability of such reports, particularly for interested parties that are not familiar with drilling operations.

In accordance with at least one embodiment of the present disclosure, a drilling report model may include a foundation model, such as an LLM, trained to generate a plain language drilling report based on a plurality of operator reports. The foundation model may generate drilling reports written from the perspective of a particular persona. A drilling operation may include multiple specialists or experts. Such specialists may develop reports or sections of reports that are focused on the impact of their specialty on the drilling operation. As a set of specific, non-limiting examples, a bit engineer may provide a report or a section of a report related to the operation of a bit, a fluids engineer may provide a report or section of a report related to the performance of the drilling fluid, or the impact of the performance of the drilling fluid on the drilling operation, a geologist may provide a report or section of a report related to the geology of the wellbore, a mechanic may provide a report or section of a report related to the operating status of drilling equipment, a surveyor may provide a report or sections of a report related to survey results, and so forth. The drilling report model may be trained to generate the drilling report from the perspective of a particular persona, thereby providing specialized information related to the persona's area of expertise.

In accordance with at least one embodiment of the present disclosure, the drilling report model may generate the drilling report based on multiple operator reports with enhancements from service companies reports if available. At a drilling operation, the various specialists may provide different operator reports based on the operation of their particular areas of interest. But drilling operations are holistic operations in which multiple specialists' areas of expertise may combine to progress the drilling operation. The drilling report model may be trained on multiple drilling reports over the same time period. When the drilling report model generates a drilling report, the drilling report model may identify a primary source based on the identified persona, and one or more secondary sources based on the interactions of various other specialists and the identified persona. Utilizing such horizontal integration, the drilling report model may develop drilling reports having improved quality and relevance.

In some situations, a particular interested party (e.g., client) may have specific requirements or requests for drilling reports they receive. For example, a particular interested party may desire specific details or a specific format. In accordance with at least one embodiment of the present disclosure, the drilling report model may be trained to generate the drilling reports to comply with the requests of the client. In this manner, the drilling reports may be more relevant.

As illustrated by the foregoing discussion, the present disclosure utilizes a variety of terms to describe features and advantages of the context generation system. Additional detail is now provided regarding the meaning of a number of these terms.

For example, as used herein, a "foundation model" refers to an artificial intelligence (AI) or machine learning (ML) model that is trained to generate an output in response to an input based on a large dataset. A foundation model may include a neural network having a significant number of parameters (e.g., billions of parameters) that the foundation model can consider in performing a task or otherwise generating an output based on an input. In one or more embodiments described herein, a foundation model is trained to generate a response to a query. In some implementations, a foundation model refers to a large language model (LLM). The foundation model may be trained in pattern recognition and text prediction. For example, the foundation model may be trained to predict the next word of a particular sentence or phrase. In one or more implementations described herein, the foundation model refers specifically to an LLM, though other types of foundation models may be used in generating responses to input queries.

As used herein, the term "persona" refers to a frame of reference for generating a drilling report. For example, the term "persona" may refer to the author of a drilling report, or who the author would be had the drilling report been written by a person. In some examples, the term "persona" may refer to the subject-matter focus of the drilling report. In some examples, the term "persona" may refer to a level of detail in a report.

As used herein, a "drilling report" refers to a report on an activity performed during well construction. A "drilling report" may refer to a report generated for an activity performed for, in, and around wellbores, including in the areas of well construction, completion, production, drilling, intervention, and so forth. Such drilling reports may include reports specific to a particular aspect of the wellbore construction domain, including aspects not directly related to "drilling." For example, a drilling report may include information associated with support services, 3rd party services, and so forth.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

As discussed herein, when the drilling system 100 performs drilling operations, one or more specialists or operators may generate an operator report. The operator report may include any type of operation information, including operation information regarding the earth formation 101, the wellbore 102, the drill rig 103, the drilling tool assembly 104, the drill string 105, the BHA 106, the casing 107, the drill pipe 108, the bit 110, any other equipment or elements, and combinations thereof.

A drilling report model may generate a drilling report based on the operating reports from the drilling system 100. In some embodiments, the drilling report model may generate the drilling report based on a particular person, or from the perspective of a particular persona. The persona may be associated with a subject matter or a role at the drilling system 100. The drilling report model may generate the drilling report based on the persona to provide information based on the expertise of the persona.

In some embodiments, the drilling report model may generate the drilling report using multiple operating reports. For example, the drilling report model may retrieve information from a primary source associated with a particular subject matter or persona. But drilling operations in the drilling system 100 may be impacted by multiple personas or multiple subjects, and operator reports may incorporate how other elements of the drilling system 100 may impact their particular area of expertise. The drilling report model may horizontally integrate secondary operator reports to determine the impact of a particular subject matter or persona on the drilling system 100.

Figure 2:
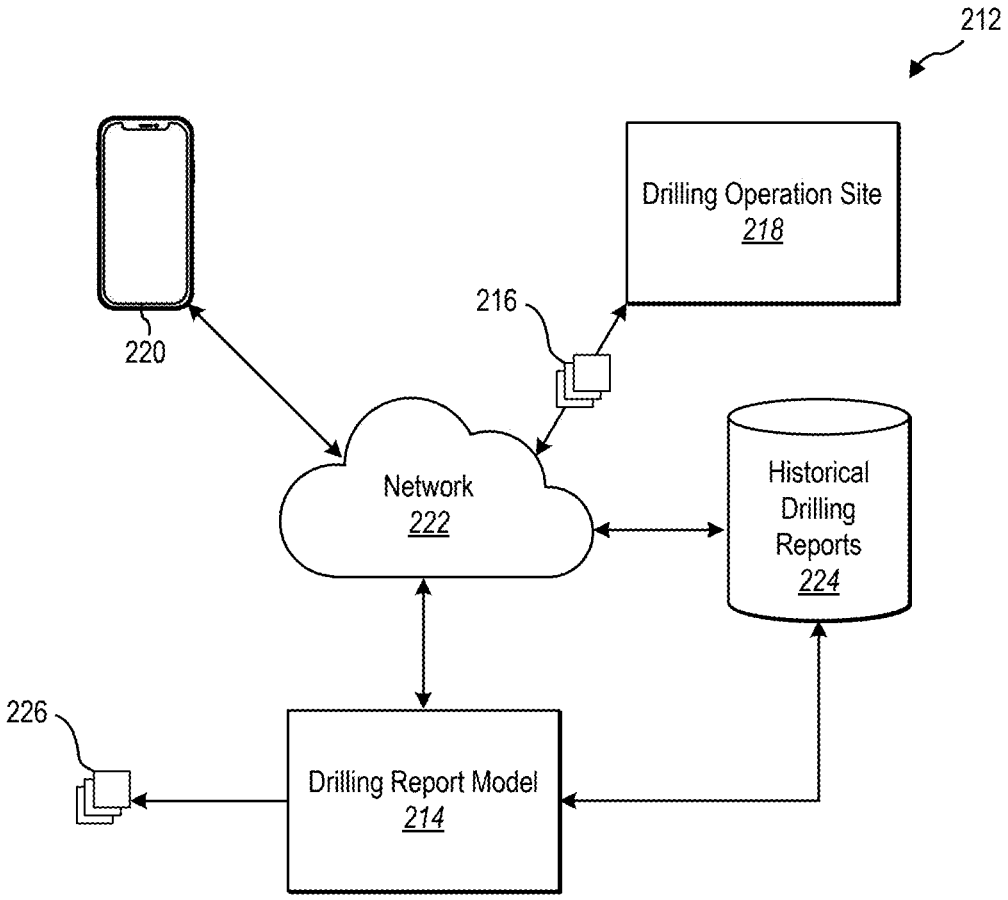
FIG. 2 is a schematic representation of a drilling report generation system, according to at least one embodiment of the present disclosure.

FIG. 2 is a schematic representation of a drilling report generation system 212, according to at least one embodiment of the present disclosure. A drilling report model 214 may receive operating reports 216 from a drilling operation site 218. For example, one or more operators at the drilling operation site 218 may generate operating reports 216. The operating reports 216 may include one or more operating codes. The operating codes may be pre-determined letter and/or number sequences that are associated with a particular pre-assigned activity. An operator may generate the operating report 216 by recording the operating code and the time during which the pre-assigned activity is performed. The operator may further include a text description of the tasks performed while performing the pre-assigned activity. But as discussed herein, the text description may be shorthand, or use technical language and acronyms that may not be readily understood by others without the same level of expertise or training as the operator.

Multiple operators may generate the operating reports 216. For example, different operators having different technical specialties and/or different roles on the drilling operation site 218 may generate different operating reports 216. Collecting, consolidating, and summarizing all of the operating reports 216 may be a difficult and time-consuming job, and may not be possible for an operator or other professional to perform in a timely manner.

The drilling report model 214 may be in communication with the drilling operation site 218 and a user device 220 over a network 222, such as the Internet, a local area network (LAN), or other network 222. The drilling report model 214 may receive the query.

A user, at the user device 220, may desire a drilling report based on the operating reports 216. The user device 220 may provide a query to the drilling report model 214 to prepare the drilling report. The query may include relevant information for the desired drilling report. For example, the query may include the type of report. Without limiting the disclosure, sample types of reports may include plain language reports, general summaries, subject-matter summaries, technical reports, detailed reports, graphical reports, any other report, and combinations thereof.

In some embodiments, the query may be a textual query. For example, the user may prepare a text input question in the user device 220 to provide to the drilling report generation system 212. In some embodiments, the query may be based on other information. For example, a user may provide a graphic or multiple graphics illustrating operations information in the user device 220 and ask for a drilling report related to the information on the screen. This may increase the flexibility of query inputs.

In some embodiments, the user device 220 may generate a prompt for the drilling report model 214. For example, the user device 220 may generate a prompt including context. The drilling report model 214 may use the context to generate the drilling report. The context in the prompt may include information from the query. For example, the context of the prompt may include a persona, a target client, a subject matter, a primary source, one or more secondary sources, any other context, and combinations thereof. In some embodiments, a remote computing device may generate the prompt. For example, the drilling report model 214 may be hosted on a remote server, and a module on the server may generate the prompt based on the query submitted by the user at the user device 220.

The drilling report model 214 may be a foundation model. Indeed, the drilling report model 214 may include any type of foundation model, such as a large language model (LLM). The drilling report model 214 may be trained and/or fine-tuned to develop drilling reports. For example, the drilling report model 214 may be trained and/or fine-tuned based on historical drilling reports 224. The historical drilling reports 224 may include historical operating reports and historical drilling reports. The historical drilling reports may be annotated to associate portions of the historical drilling reports with the operating reports, including associations based on persona, subject matter, client preference, and so forth. During training, the drilling report model 214 may develop correlations between language in the operations reports and the drilling reports, including information that is important to include in the drilling report and information that is not desired in the drilling report.

When the drilling report model 214 receives the prompt generated by the query, the drilling report model 214 may retrieve the relevant operating reports 216. For example, the context from the prompt may include a desired timeframe and/or desired sources. The drilling report model 214 may retrieve the operating reports 216 based on the timeframe and the desired sources. Using the retrieved operating reports 216, the drilling report model 214 may generate one or more drilling reports 226. The one or more drilling reports 226 may be tailored to the information in the query from the user device 220. This may improve the quality and/or relevance of the drilling reports.

Figure 3:
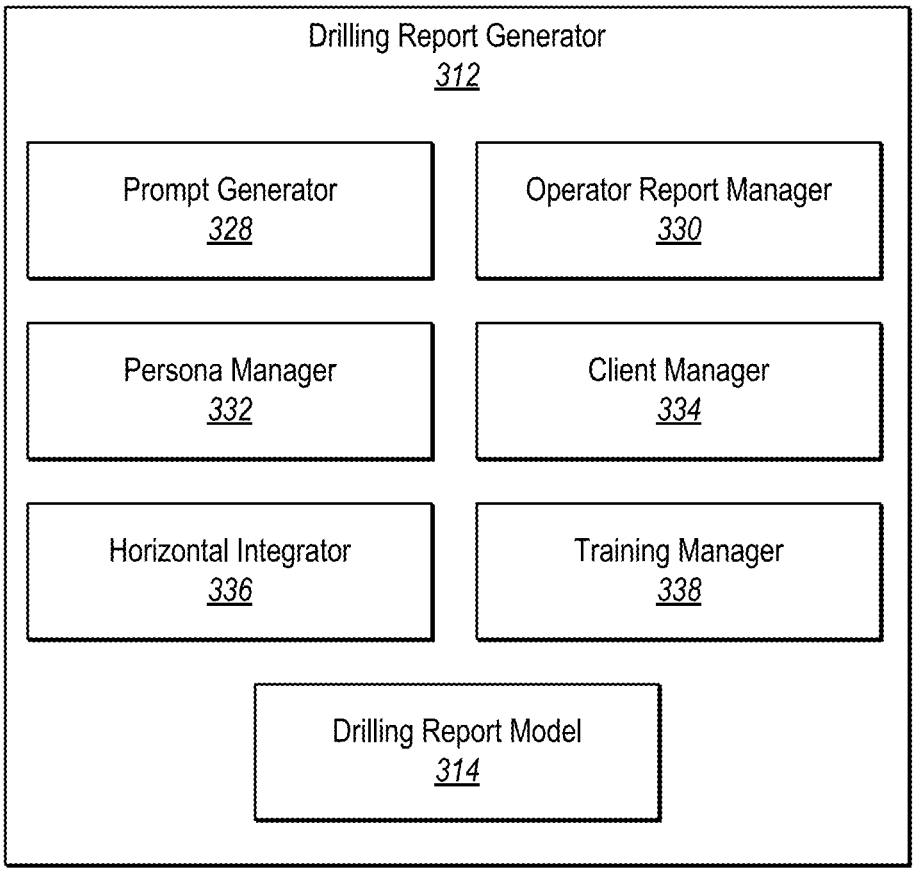
FIG. 3 is a representation of a drilling report generation system, according to at least one embodiment of the present disclosure.

FIG. 3 is a representation of a drilling report generation system 312, according to at least one embodiment of the present disclosure. Each of the components of the drilling report generation system 312 can include software, hardware, or both. For example, the components can include one or more instructions stored on a computer-readable storage medium and executable by processors of one or more computing devices, such as a client device or server device. When executed by the one or more processors, the computer-executable instructions of the drilling report generation system 312 may cause the computing device(s) to perform the methods described herein. Alternatively, the components may include hardware, such as a special-purpose processing device to perform a certain function or group of functions. Alternatively, the components of the drilling report generation system 312 may include a combination of computer-executable instructions and hardware.

Furthermore, the components of the drilling report generation system 312 may, for example, be implemented as one or more operating systems, as one or more stand-alone applications, as one or more modules of an application, as one or more plug-ins, as one or more library functions or functions that may be called by other applications, and/or as a cloud-computing model. Thus, the components may be implemented as a stand-alone application, such as a desktop or mobile application. Furthermore, the components may be implemented as one or more web-based applications hosted on a remote server. The components may also be implemented in a suite of mobile device applications or "apps."

The drilling report generation system 312 may include a prompt generator 328. When the drilling report generation system 312 receives a query from a user or a user device, the prompt generator 328 may process the query. The prompt generator 328 may identify relevant information in the query to generate the prompt. For example, the prompt generator 328 may identify the desired report, a time period of interest, a depth section, subject matter, a persona, a target audience (e.g., the client), a set of sources, and so forth.

Using the information from the query, the prompt generator 328 may generate a prompt. The prompt may be a contextual prompt. For example, the prompt may include context information based on the information from the query. Such context information may include the report type, the time period of interest, the depth section, the subject matter, the persona, the client, the set of sources, and so forth. The report type may be any report type. For example, the report type may include the format of the report, such as a plain language report, a bullet list, graphical information, audiovisual information, any other report type, and combinations thereof. The time period of interest may be a temporal duration, including any temporal duration outlined in the query, including a period of minutes, hours, days, weeks, months, or the entire project. The depth section may be a depth or range of depths of the wellbore and/or a depth or ranges of depths of a particular tool that operated within the wellbore. The subject matter may include the desired subject matter of the report. This may be based on a particular expertise of an operator in the drilling system, a particular drilling operation performed, a particular support task performed, and so forth. As discussed herein, the persona may include the point of view from which the report is generated. The target audience or client may be a representation of for whom the report is generated, and may influence the report type, content in the report, a level of detail within the report, and so forth. The set of sources may be a representation of the sources from which the report may pull. For example, the set of sources may be the operating reports retrieved by the drilling report generation system 312 to generate the report.

The resulting prompt may be any type of prompt. For example, the prompt generator 328 may be a foundation model configured to generate a textual prompt that may be readily parsed by an LLM. In some examples, the prompt generator 328 may generate a structured prompt including structured data. In some embodiments, the prompt generator 328 may generate a prompt including a combination of structured and unstructured data.

Based on the query and/or the prompt, an operator report manager 330 may retrieve the relevant operator reports. The operator report manager 330 may identify the relevant operator reports based on the information in the prompt, including the contextual information. For example, the operator report manager 330 may retrieve the operator reports based on the report type, the time period of interest, the depth section, the subject matter, the persona, the client, the set of sources, and so forth. In some examples, the operator report manager 330 may identify the relevant reports based on metadata tags in the report, based on annotations from the reports, based on the operating codes, based on any other information from the operating reports, and combinations thereof.

As discussed herein, the operator report manager 330 may retrieve more than one report. For example, the drilling report generation system 312 may utilize horizontal integration to generate the drilling reports. The operator report manager 330 may identify primary sources as sources primarily based on the relevant subject matter and/or persona. The operator report manager 330 may further identify secondary sources as sources that include information related to the subject matter and/or information utilized by the identified persona. In this manner, the operator report manager 330 may retrieve the appropriate reports to generate the drilling report based on the input prompt.

In some embodiments, the prompt generator 328 may identify the specific reports to be used to generate the drilling report. For example, the prompt generator 328 may include the specific reports by a particular report identification. In some examples, the prompt generator 328 may include the specific reports based on a particular author of the operating report, or a particular institutional author (e.g., a particular contractor or subcontractor). In some examples, the prompt generator 328 may identify which operating reports are the primary source(s) and which operating reports are the secondary source(s). In some embodiments, the prompt generator 328 may identify the different personas associated with the primary source(s) and the secondary source(s). For example, the prompt generator 328 may identify the different frames of reference of the primary source(s) and the secondary source(s).

In some embodiments, the prompt generator 328 and/or the operator report manager 330 may identify operator codes in the primary sources and the secondary sources. In some embodiments, the prompt generator 328 may identify the primary source and/or the secondary sources by the operator codes. For example, as discussed herein, an operator code may be associated with a pre-assigned activity. The prompt generator 328 may identify an activity of interest, and pull secondary sources that include drilling codes having a pre-assigned activity associated with the activities of interest that occurred over the time period of interest. This may facilitate identification of secondary sources that may otherwise not have been used to generate the drilling report.

A persona manager 332 may identify the personas for operator reports. For example, a drilling report model 314 may generate a drilling report. The resulting drilling report may have a persona, which may be the perspective or the point of view from which the report will be written. The persona manager 332 may identify personas in the operator reports. In some embodiments, when the drilling report model 314 is generating the report, the persona manager 332 may provide input regarding the content of the report. For example, the persona manager 332 may provide subject matter expertise associated with the report. The persona manager 332 may further provide information the operator report manager 330 to identify and retrieve the appropriate reports.

A client manager 334 may identify client-specific preferences for the reports generated by the drilling report model 314. For example, the client manager 334 may analyze various historical drilling reports and identify patterns for specific clients. The client manager 334 may identify the client preferences in the drilling reports. Based on the client information in the prompt, the client manager 334 may provide the drilling report model 314 the client preferences.

A horizontal integrator 336 may identify operating reports that include relevant information based on the prompt. For example, the horizontal integrator 336 may identify operating reports that have overlapping subject matter to the subject matter of the prompt. In some examples, the horizontal integrator 336 may identify operating reports that have subject matter related to or relevant to the persona from the prompt. The horizontal integrator 336 may identify the relevant operating reports to the operator report manager 330 to retrieve.

The drilling report model 314 may generate the drilling report based on the prompt. To generate the report, the drilling report model 314 may receive the operating reports from the operator report manager 330. The drilling report model 314 may be trained by a training manager 338 to generate the drilling reports based on the inputs from the prompt. For example, the drilling report model 314 may be trained to generate a report from a particular persona. The drilling report model 314 may receive persona information from the persona manager 332 and generate the report from the perspective of the persona.

In some examples, the drilling report model 314 may be trained by the training manager 338 to generate a report that captures information from multiple sources, including a primary source and one or more secondary sources, as identified by the horizontal integrator 336 and retrieved by the operator report manager 330. In some examples, the drilling report model 314 may be trained by the training manager 338 to generate a report that is directed to a particular client. The drilling report model 314 may receive the client information from the client manager 334 to develop the client-specific drilling report.

Figure 4:
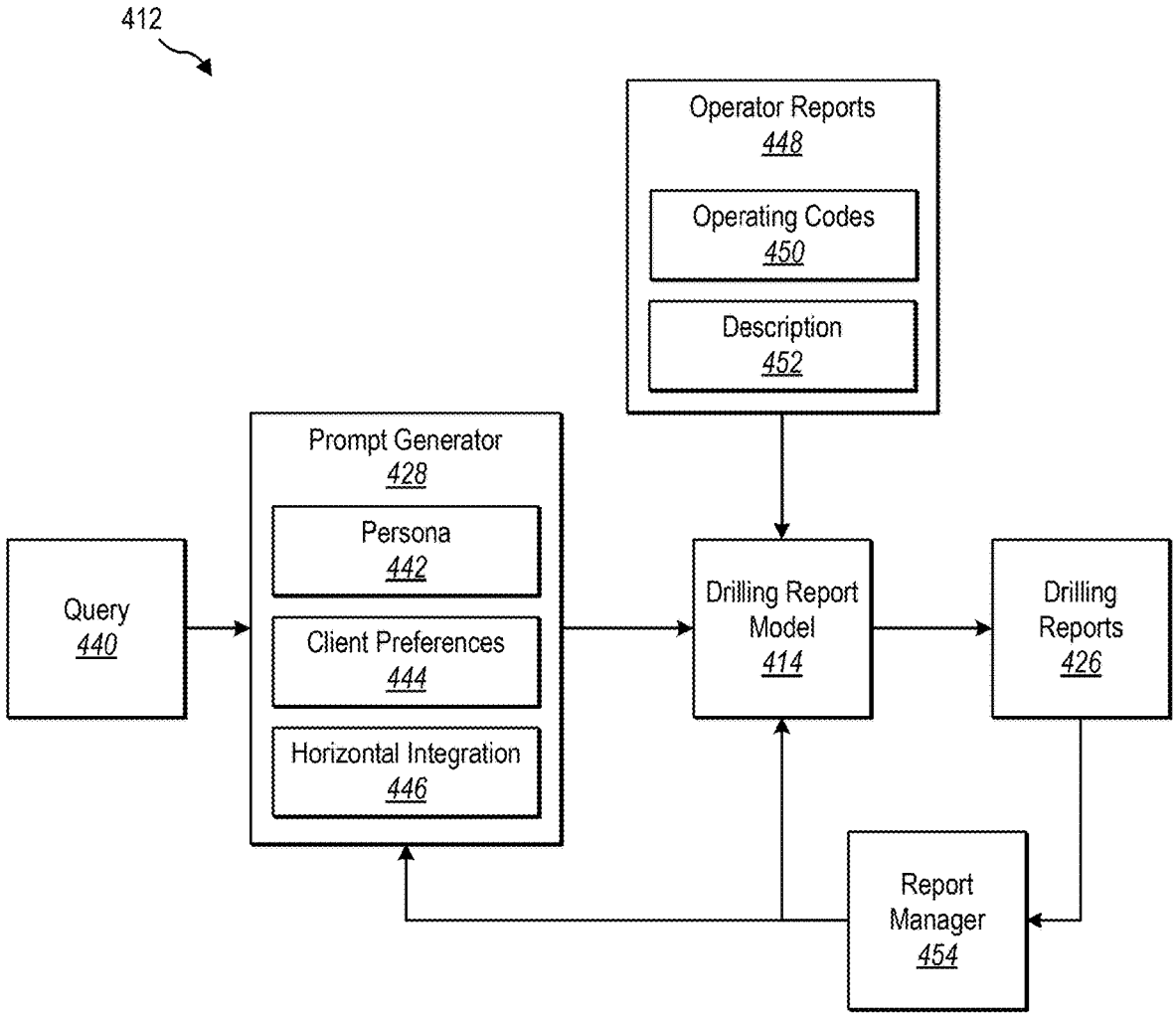
FIG. 4 is a representation of a drilling report generation system, according to at least one embodiment of the present disclosure.

FIG. 4 is a representation of a drilling report generation system 412, according to at least one embodiment of the present disclosure. The drilling report generation system 412 may generate one or more drilling reports 426 based on inputs from a user. For example, a user may input a query 440 to the drilling report generation system 412. As discussed herein, the query 440 may include information relevant to the drilling reports 426 desired. For example, the query 440 may include the desired drilling report 426 format, including the desired persona and/or client output.

A prompt generator 428 may generate a prompt based on the query 440. For example, the prompt generator 428 may identify one or more desired elements of the drilling reports 426. The prompt generator 428 may, based on the query, generate a prompt to input to a drilling report model 414. The prompt may include context based on the query 440. The context may include any type of context, such as a persona 442, a client preference 444, and/or horizontal integration 446.

When the drilling report model 414 receives the prompt, the drilling report model 414 may receive, as input, operator reports 448. The operator reports 448 may be the raw reports directly generated by the operator. The operator reports 448 may include operation information. The operating information may include operating codes 450. The operating codes 450 may be pre-determined codes associated with pre-assigned activities. The operator reports 448 may further include a description 452 for the activities identified by the operating codes 450. The description 452 may be the operator's description of the specific details of the operation performed.

The drilling report model 414 may generate the drilling report 426 based on the prompt and the inputted operator reports 448. As discussed herein, the drilling report model 414 may be trained to develop the drilling report 426. In some embodiments, the drilling report 426 may be used to fine-tune the drilling report model 414. For example, a report manager 454 may receive the drilling report 426. The report manager 454 may compare the drilling report 426 to the prompt to determine if the drilling report 426 contains the information requested by the query. For example, the report manager 454 may determine whether the drilling report 426 has the persona identified in the query. In some examples, the report manager 454 may determine whether the drilling report 426 incorporates information from horizontally integrated operator reports 448. In some examples, the report manager 454 may determine whether the drilling report 426 includes the requested client information. In some examples, the report manager 454 may determine whether the drilling report 426 includes any other requested information or context from the query. In some examples, the report manager 454 may determine whether the drilling report 426 includes accurate information from the operator reports 448.

In some embodiments, the report manager 454 may train the drilling report model 414 based on the comparison with the query. For example, the report manager 454 may annotate the content of the drilling report 426 based on the comparison with the query and the operator reports. The report manager 454 may cause a change in one or more of the parameters of the drilling report model 414 to increase the relevance and/or accuracy of the drilling report model 414.

In some embodiments, the report manager 454 may train or change the operation of the prompt generator 428 based on the drilling report 426. For example, the report manager 454 may cause the prompt generator 428 to adjust the prompt based on the comparison of the drilling report 426 with the query and/or the operator reports 448. By training the drilling report model 414 and the prompt generator 428, the report manager 454 may facilitate increased accuracy and/or relevance of the drilling report 426 to the query and/or the operator reports 448.

Figure 5:
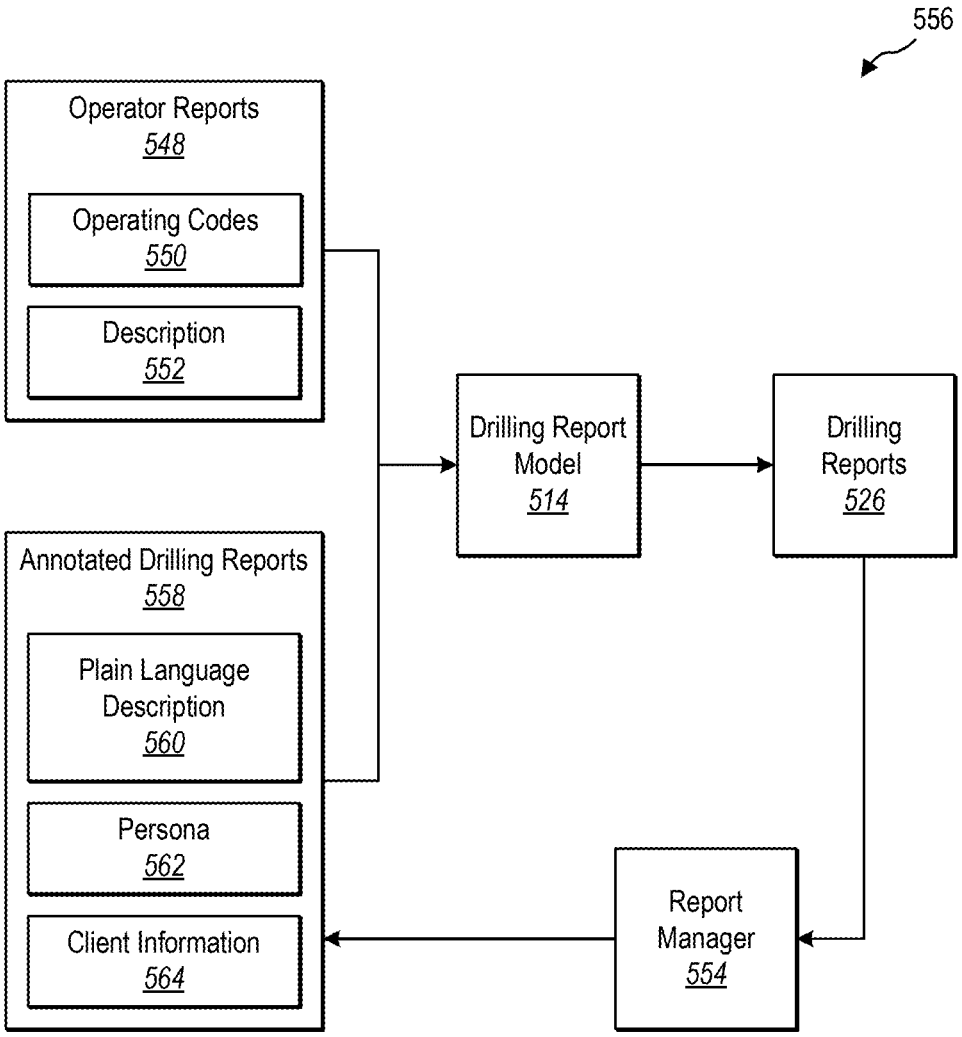
FIG. 5 is a representation of a drilling report model training system, according to at least one embodiment of the present disclosure.

FIG. 5 is a representation of a drilling report model training system 556, according to at least one embodiment of the present disclosure. The drilling report model training system 556 may be used to train or fine-tune a drilling report model 514 to generate drilling reports 526. To train or fine-tune the drilling report model 514, the drilling report model 514 may receive historical operator reports 548 and annotated drilling reports 558. The drilling report model 514 may be trained on the historical operator reports 548 and the annotated drilling reports 558 to develop correlations between elements of the historical operator reports 548 and the annotated drilling reports 558.

For example, the operator reports 548 may include operator codes 550 and descriptions 552. The annotated drilling reports 558 may include a plain language description 560, a persona 562, and client information 564. The annotated drilling reports 558 may include annotations correlating the plain language description 560 to the operator codes 550 and the descriptions 552, the persona 562 with an author of the historical operator reports 548, and the client information 564 with a particular client. When the drilling report model 514 is trained or fine-tuned on the historical operator reports 548 and the annotated drilling reports 558, the drilling report model 514 may develop the correlations between the historical operator reports 548 and the annotated drilling reports 558.

The resulting drilling report 526 may further be used to train the drilling report model 514. For example, a report manager 554 may receive the drilling report 526 and annotate the drilling report based on its content. The report manager 554 may provide the drilling report 526 to the set of annotated drilling reports 558 to further fine-tune the drilling report model 514. In some embodiments, the report manager 554 may generate a new drilling report 526 generated by new operator reports. The report manager 554 may annotate the new drilling report 526 and the annotated new drilling report 526 may be used to further train the drilling report model 514. In this manner, the drilling report model 514 may generate more accurate and/or more relevant drilling reports.

Figure 6:
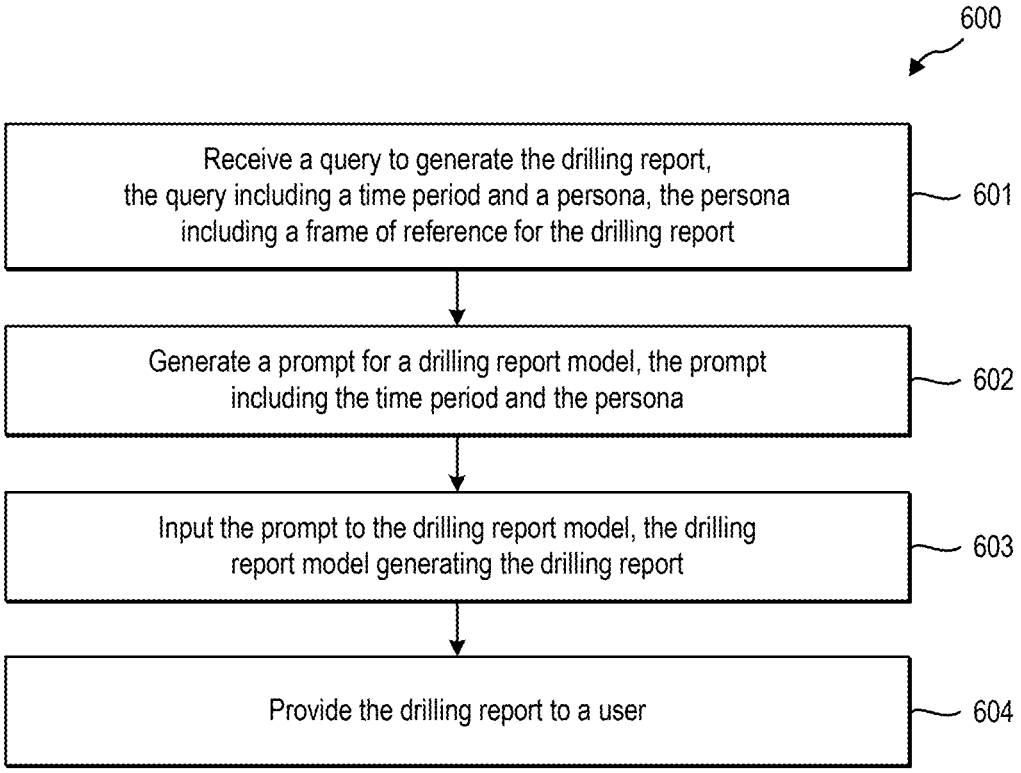
FIG. 6 is a flowchart of a method for generating a drilling report, according to at least one embodiment of the present disclosure.
Figure 7:
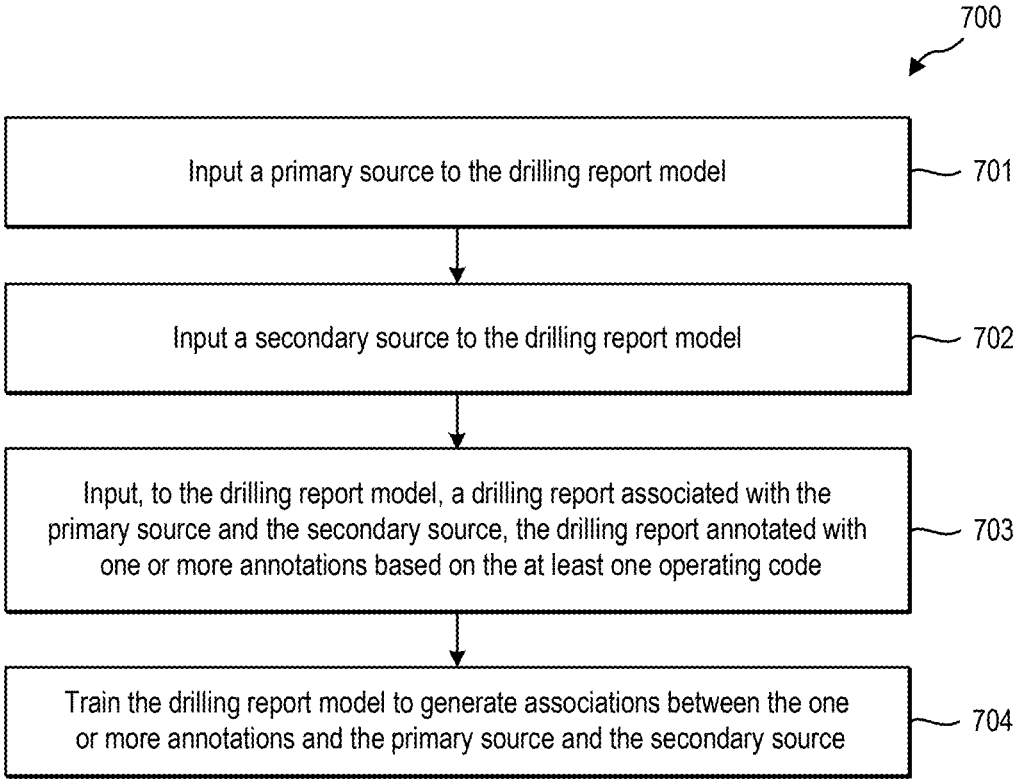
FIG. 7 is a flowchart of a method for generating a drilling report, according to at least one embodiment of the present disclosure.

FIGS. 6 and 7, the corresponding text, and the examples provide a number of different methods, systems, devices, and computer-readable media of the drilling report generation system. In addition to the foregoing, one or more embodiments can also be described in terms of flowcharts comprising acts for accomplishing a particular result, as shown in FIGS. 6 and 7. FIGS. 6 and 7 may be performed with more or fewer acts. Further, the acts may be performed in differing orders. Additionally, the acts described herein may be repeated or performed in parallel with one another or parallel with different instances of the same or similar acts.

As mentioned, FIG. 6 illustrates a flowchart of a series of acts or a method 600 for generating a drilling report, according to at least one embodiment of the present disclosure. While FIG. 6 illustrates acts according to one embodiment, alternative embodiments may omit, add to, reorder, and/or modify any of the acts shown in FIG. 6. The acts of FIG. 6 can be performed as part of a method. Alternatively, a computer-readable medium can comprise instructions that, when executed by one or more processors, cause a computing device to perform the acts of FIG. 6. In some embodiments, a system can perform the acts of FIG. 6.

A drilling report generation system may receive a query to generate a drilling report at 601. The query may include a time period and a persona. The persona may include a frame of reference for the drilling report. The drilling report generation system may generate a prompt for a drilling report model based on the query at 602. The prompt includes the time period and the persona. The drilling report generation system may input the prompt to the drilling report model at 603. The drilling report model may generate the drilling report based on a primary source and one or more secondary sources. The primary source and the secondary sources include subject matter associated with the persona. The drilling report generation system may then provide the drilling report to a user at 604.

The query and the prompt may be customized based on user and client preferences. For example, the query may include client information, and the prompt may be generated with the client information. When the drilling report model receives the prompt, the drilling report model may be trained based on the client information to generate the drilling report with the client information.

In some embodiments, as discussed herein, the prompt may identify the primary source and the secondary sources based on the identified persona. In some embodiments, the drilling report model may only consider the primary source and the secondary source included in the prompt. In some embodiments, the drilling report model may consider other sources not included in the prompt.

In some embodiments, the primary source may be written from the frame of reference of the persona. For example, the primary source may have the same frame of reference as the persona, thereby including details related to the persona and elements of interest associated with the persona. In some embodiments, the secondary references are written from different frames of reference than the persona. For example, the secondary references may be written by different authors while incorporating or using information that may be relevant to or provided by the primary source or the persona associated with the primary source.

In some embodiments, the query (and the resulting prompt) may include a request regarding how the different frame of reference in the secondary source impacts the persona. For example, the query (and the resulting prompt) may include a request regarding how information from the secondary source impacts the primary source. In some examples, the query (and the resulting prompt) may include a request regarding how information from the primary source impacts the secondary source. This may cause the drilling report generation system to identify secondary references and/or identify information important to the query.

As mentioned, FIG. 7 illustrates a flowchart of a series of acts or a method 700 for generating a drilling report, according to at least one embodiment of the present disclosure. While FIG. 7 illustrates acts according to one embodiment, alternative embodiments may omit, add to, reorder, and/or modify any of the acts shown in FIG. 7. The acts of FIG. 7 can be performed as part of a method. Alternatively, a computer-readable medium can comprise instructions that, when executed by one or more processors, cause a computing device to perform the acts of FIG. 7. In some embodiments, a system can perform the acts of FIG. 7.

A drilling report generation system may input a primary source to the drilling report model at 701. The primary source includes an operator report having at least one operating code and a description. The at least one operating code is associated with a pre-assigned activity. The description describes the pre-assigned activity. The drilling report generation system may input a secondary source to the drilling report model at 702. The drilling report generation system may input a drilling report associated with the primary source and the secondary source at 703. The drilling report may be annotated with one or more annotations based on the operating code, the description, the primary source, the secondary source, and the persona associated with the at least one operating code. The drilling report generation system may train the drilling report model to generate associations between the one or more annotations and the primary source and the secondary source at 704.

In some embodiments, the secondary source includes a second operator report, different from the first operator report associated with the primary report. In some embodiments, the primary source and the secondary source are written by different operators or authors. In some embodiments, the secondary source includes the at least one operating code. For example, the primary source and the secondary source may include one or more overlapping operating codes. In some embodiments, the overlapping operating codes may be associated with the subject matter or activity of interest. In some embodiments, the persona is based on an author of the primary source. In some embodiments, the persona is different from the primary source and the secondary source.

Figure 8:
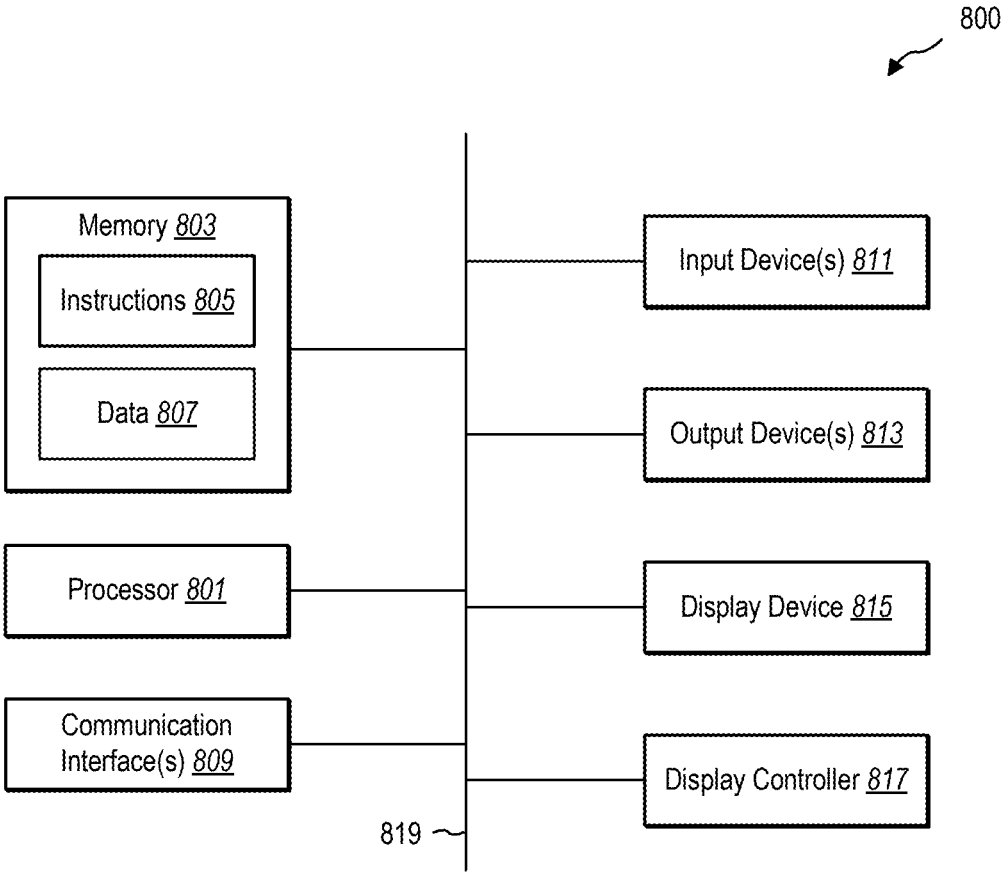
FIG. 8 is a representation of a computing system, according to at least one embodiment of the present disclosure.

FIG. 8 illustrates certain components that may be included within a computer system 800. One or more computer systems 800 may be used to implement the various devices, components, and systems described herein.

The computer system 800 includes a processor 801. The processor 801 may be a general-purpose single or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 801 may be referred to as a central processing unit (CPU). Although just a single processor 801 is shown in the computer system 800 of FIG. 8, in an alternative configuration, a combination of processors (e.g., an ARM and DSP) could be used.

The computer system 800 also includes memory 803 in electronic communication with the processor 801. The memory 803 may be any electronic component capable of storing electronic information. For example, the memory 803 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM) memory, registers, and so forth, including combinations thereof.

Instructions 805 and data 807 may be stored in the memory 803. The instructions 805 may be executable by the processor 801 to implement some or all of the functionality disclosed herein. Executing the instructions 805 may involve the use of the data 807 that is stored in the memory 803. Any of the various examples of modules and components described herein may be implemented, partially or wholly, as instructions 805 stored in memory 803 and executed by the processor 801. Any of the various examples of data described herein may be among the data 807 that is stored in memory 803 and used during execution of the instructions 805 by the processor 801.

A computer system 800 may also include one or more communication interfaces 809 for communicating with other electronic devices. The communication interface(s) 809 may be based on wired communication technology, wireless communication technology, or both. Some examples of communication interfaces 809 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 800 may also include one or more input devices 811 and one or more output devices 813. Some examples of input devices 811 include a keyboard, mouse, microphone, remote control device, button, joystick, trackball, touchpad, and lightpen. Some examples of output devices 813 include a speaker and a printer. One specific type of output device that is typically included in a computer system 800 is a display device 815. Display devices 815 used with embodiments disclosed herein may utilize any suitable image projection technology, such as liquid crystal display (LCD), light-emitting diode (LED), gas plasma, electroluminescence, or the like. A display controller 817 may also be provided, for converting data 807 stored in the memory 803 into text, graphics, and/or moving images (as appropriate) shown on the display device 815.

The various components of the computer system 800 may be coupled together by one or more buses, which may include a power bus, a control signal bus, a status signal bus, a data bus, etc. For the sake of clarity, the various buses are illustrated in FIG. 8 as a bus system 819.

The embodiments of the drilling report generation system have been primarily described with reference to wellbore drilling operations; the drilling report generation systems described herein may be used in applications other than the drilling of a wellbore. In other embodiments, drilling report generation systems according to the present disclosure may be used outside a wellbore or other downhole environment used for the exploration or production of natural resources. For instance, drilling report generation systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for generating a drilling report, the method comprising:

receiving a query to generate the drilling report, the query including a time period, a drilling activity, and a persona, the persona including a frame of reference for the drilling report;

inputting the query into a prompt generator, the prompt generator identifying an activity code associated with a set of operator reports based on the drilling activity, wherein the prompt generator includes a first machine learning model;

generating, via the prompt generator, a primary source identifier and one or more secondary source identifiers, wherein the primary source identifier is based on a first association by the primary source identifier with the activity code and the one or more secondary source identifiers are based on a second association by the one or more secondary source identifiers with the activity code;

generating, via the prompt generator, a prompt for a drilling report model, the prompt including the time period, the persona, the primary source identifier, and the one or more secondary source identifiers;

inputting the prompt to the drilling report model, the drilling report model generating the drilling report, wherein the drilling report model includes a second machine learning model, and wherein the drilling report model generates the drilling report based on a primary source selected based on the primary source identifier and one or more secondary sources selected based on the one or more secondary source identifiers, the primary source and the one or more secondary sources including subject matter associated with the persona;

generating, via a report manager, an annotated drilling report based on annotating the drilling report with an annotation based on a comparison with the primary source, the one or more secondary sources, the persona, and the query;

using the annotated drilling report, training the drilling report model to generate a new drilling report based on associations between the annotation and the primary source and the one or more secondary sources and the persona, resulting in a retrained drilling report model;

training the prompt generator to generate a new prompt using the drilling report, the new drilling report, the query, and the set of operator reports, resulting in a re-trained prompt generator;

applying the new prompt to the retrained drilling report model;

outputting the new drilling report via the retrained drilling report model; and providing the new drilling report to a user.

2. The method of claim 1, wherein the query includes client information, and wherein generating the prompt includes generating the prompt with the client information, and wherein the drilling report model is trained based on the client information to generate the drilling report with the client information.

3. The method of claim 1, wherein the prompt identifies the primary source and the one or more secondary sources based on the persona.

4. The method of claim 3, wherein the drilling report model only considers the primary source and the one or more secondary sources in the prompt.

5. The method of claim 1, wherein the primary source is written from the frame of reference of the persona.

6. The method of claim 1, wherein the one or more secondary sources are written from a different frame of reference than the persona.

7. The method of claim 6, wherein the query includes a request regarding how the different frame of reference impacts the persona.

8. A drilling report generation system, comprising:

a processor and memory, the memory including instructions that cause the processor to:

receive a query to generate a drilling report, the query including a time period, a drilling activity, and a persona, the persona including a frame of reference for the drilling report;

input the query into a prompt generator, the prompt generator identifying an activity code associated with a set of operator reports based on the drilling activity, wherein the prompt generator includes a first machine learning model;

generate, via the prompt generator, a primary source identifier and one or more secondary source identifiers, wherein the primary source identifier is based on a first association by the primary source identifier with the activity code and the one or more secondary source identifiers are based on a second association by the one or more secondary source identifiers with the activity code;

generate, via the prompt generator, a prompt for a drilling report model, the prompt including the time period, the persona, the primary source identifier, and the one or more secondary source identifiers;

input the prompt to the drilling report model, the drilling report model generating the drilling report, wherein the drilling report model includes a second machine learning model, and wherein the drilling report model generates the drilling report based on a primary source selected based on the primary source identifier and one or more secondary sources selected based on the one or more secondary source identifiers, the primary source and the one or more secondary sources including subject matter associated with the persona;

generate, via a report manager, an annotated drilling report based on annotating the drilling report with an annotation based on a comparison with the primary source, the one or more secondary sources, the persona, and the query;

using the annotated drilling report, train the drilling report model to generate a new drilling report based on associations between the annotation and the primary source and the one or more secondary sources and the persona, resulting in a retrained drilling report model;

train the prompt generator to generate a new prompt using the drilling report, the new drilling report, the query, and the set of operator reports, resulting in a re-trained prompt generator;

apply the new prompt to the retrained drilling report model output the new drilling report via the retrained drilling report model; and provide the new drilling report to a user.

9. The drilling report generation system of claim 8, wherein the query includes client information, and wherein generating the prompt includes generating the prompt with the client information, and wherein the drilling report model is trained based on the client information to generate the drilling report with the client information.

10. The drilling report generation system of claim 8, wherein the prompt identifies the primary source and the one or more secondary sources based on the persona.

11. The drilling report generation system of claim 10, wherein the drilling report model only considers the primary source and the one or more secondary sources in the prompt.

12. The drilling report generation system of claim 8, wherein the primary source is written from the frame of reference of the persona.

13. The drilling report generation system of claim 8, wherein the one or more secondary sources are written from a different frame of reference than the persona.

14. The drilling report generation system of claim 13, wherein the query includes a request regarding how the different frame of reference impacts the persona.

* * * * *